United States Patent [19]

Huber

[11] 4,140,360

[45] Feb. 20, 1979

[54] CONNECTOR FOR MASS TERMINATION OF FLAT MULTIPLE WIRE CABLE

[75] Inventor: John H. Huber, Harrisburg, Pa.

[73] Assignee: AMP Incorporated, Harrisburg, Pa.

[21] Appl. No.: 841,880

[22] Filed: Oct. 13, 1977

[51] Int. Cl.[2] ..... H01R 13/36

[52] U.S. Cl. ..... 339/176 MF

[58] Field of Search ..... 339/19, 97 P, 98, 99 R, 339/176 MF, 222

[56] References Cited

U.S. PATENT DOCUMENTS 3,496,522 2/1970 Ellis et al. ..... 339/99 R

*Primary Examiner*—Gerald A. Dost

[57] ABSTRACT

The combination of a flat multi-wire cable and a connector means for terminating such cable wherein a portion of the cable near the end thereof is stripped of insulation with a short section of unstripped cable between the stripped portion and the end of the cable. Wires designated as signal wires in the stripped portion are severed near the short insulated section thereof after which the short insulated section and the remaining unsevered wires, designated as ground wires, are folded back over the undisturbed insulated cable, thereby leaving the severed signal wires extending outward and over two parallel rows of first slotted contacts secured in a first housing section. By an appropriate tool the extended signal wires are simultaneously inserted in said first slots in parallel manner and without solder. A second housing section is installed over the first housing section to retain the first contacts in said first slots. Said second housing section contains two parallel rows of second slotted contacts positioned over the first two rows of contacts and over which the end of the cable being terminated is folded to bring said ground wires over and subsequently secured in the slots of the second contacts, also by an appropriate tool. The main body of the cable is then folded back over the secured ground wires after which a third housing section, which is a cap, is installed thereover. Each of the second slotted contacts has a tab formed thereon which can be a cantilevered spring contact and which can be either removed or which can make an electrical connection with one of the first contacts positioned therebelow. No soldering is needed nor is any spreading of the wires required although such spreading can be done, if desired.

9 Claims, 12 Drawing Figures

CONNECTOR FOR MASS TERMINATION OF FLAT MULTIPLE WIRE CABLE

BACKGROUND OF THE INVENTION

This invention relates generally to a connector for mass termination of flat multi-wire cable and more particularly to a connector which is programmable in that any signal wire or signal wire position can be selectively grounded and which terminates the cable without spreading the individual wires, thereby maintaining centerline compatibility with other standard connectors, and further allowing for two ground wires for each signal wire.

There are currently available connectors for effecting mass terminations of the wires of a flat transmission cable. One such connector employs one or more rows of contacts mounted in a housing bed with the contacts of each row staggered with respect to the contacts of the other row or rows. Each contact has a slot which opens onto the top end of the contact to receive a cable wire therein. It has not, however, been possible to maintain the cable wire centerlines in the connector. On the contrary, it has been necessary to spread the cable wires apart so they can be inserted in the slots in the contacts, thereby losing centerline compatibility with many existing connectors already extensively used in industry.

In another prior art connector, the centerline spacing of the cable wires is maintained. Such connector comprises two rows of pairs of elongated contacts which are secured at first ends in a housing to form two rows of female receptacles for the reception of terminal posts or the like and opening onto a first side of the connector housing. Tabs positioned at the other ends of the contacts of each pair of contacts extend through another side of the housing where they are bent over to lie substantially flat on the surface of said other side of the housing.

The flat cable to be terminated is dressed with a short section thereof being stripped of insulation along a short distance thereof in such a manner that a short section of unstripped cable extends from the stripped portion to the end of the cable being terminated. The stripped portion of the cable is positioned over the tabs of the contacts and the individual wires forced into individual notches formed in a ledge extending outwardly from the said other side of the housing, which notches are formed in two levels with the notches of the second and deeper level receiving the wires to be grounded. A cutting tool then cuts the signal wires and the remaining uncut grounded wires are then folded back over a bus bar which has been positioned along the said other surface of the housing. The bus bar has fingers extending therefrom to be individually positioned over one of the tabs of said two rows of contacts.

A bar type heating element is then brought down upon the fingers extending from the bus bar to solder the signal wires and the fingers to the tabs extending from the two rows of pairs of contacts. Simultaneously, a second bar type heating element is brought down over the bus bar to solder the wires to be grounded to said bus bar. The fingers extending from the bus bar over the tabs of the contacts can be removed prior to the assembly of the connector, and the soldering thereof, so that only preselected ones of the signal wires will be grounded. Subsequently, the main portion of the cable, which is unstripped, is folded across the top of the bus bar which has ground wires soldered thereto. A cap is then locked over the folded over cable and the connector housing to provide a strain relief function.

A principal problem involved in the prior art structure described above is the necessity for two soldering operations which adds appreciably to the cost thereof and which makes field application of the connector very difficult.

BRIEF STATEMENT OF THE INVENTION

It is a primary object of the invention to provide a means for mass termination of the wires of a flat multi-wire cable without the use of solder and without spreading the wires of the cable which would result in an undesirable increase in the centerline spacing between said wires.

It is a second purpose of the invention to provide a connector for mass termination of the wires of a cable without using solder and without spreading the wires apart and further having the capability of two ground wires between adjacent signal wires.

A third purpose of the invention is to provide a connector which will mass terminate the wires of a flat multi-wire cable in a manner whereby any desired combination of signal wires can be grounded by pre-programming a ground bus bar contained in the connector before assembly of said connector, and further without the use of any solder joints.

A fourth aim of the invention is to provide a means for mass termination of the wires of a flat cable in which two layers of contacts are positioned in the connector, one above the other, to provide two ground wires for each signal wire without spreading the cable wires and without the use of solder.

A fifth object of the invention is the improvement generally of a means for mass termination of the wires of a flat multi-wire cable.

In accordance with one form of the invention there is provided in combination with a flat multi-wire cable a connector for the mass termination of the wires of said cable and comprising a first housing portion with two rows of first plate-like contacts having their first ends secured in said housing portion and with their second ends extending upwardly from a first surface of said housing portion, and further with the contacts of each row being staggered with respect to each other. A slot is formed in each first contact and opening onto the second end thereof. A portion of the cable near its end being terminated has the insulation stripped therefrom but with a short section of unstripped cable remaining between the stripped portion and the end of the cable. The signal wires are severed at that end of the stripped portion which is nearest the end of the cable. The cable is then folded back upon itself at a fold line on the unsevered ground wires near that end of the stripped portion farthest from the end of the cable, leaving the stripped signal wires extending therefrom and positioned above the slots in said first contacts. With an appropriate tool the signal wires are inserted into the slots in the first contacts and te ends thereof cut off flush with the surface of the housing by a knife edge which is a part of the tool.

A second housing portion has a first surface configured to retain said signal wires within the slots of said first contacts and further has a second plurality of second plate-like contacts with their first ends connected to bus bar means mounted in a second surface of said housing portion and with the second ends of said second contacts extending out of said second surface of the second housing portion. The bus bar means can comprise of one or more bus bars with each second contact being connected to one of such bus bars. Alternatively, one or any of the second contacts can be electrically isolated from the remaining second contacts with a tab extending therefrom to a first contact.

Each second contact has a second, dual slot means formed therein which opens onto the second end thereof and which is capable of simultaneously receiving and retaining two wires. Such second housing portion is inserted over the first housing portion to lock the signal wires within the slots of the first contacts. The end of the cable being terminated is then unfolded so that the stripped ground wires are positioned over the said second slots in the second contacts and are then simultaneously inserted in said secons slots by the same insertion tool which is employed to insert the signal wires in the slots in the first contacts. The end of the cable is then severed by the knife edge of the insertion tool. Next,the main unstripped cable is folded back upon itself to be positioned over the second contacts. A third housing portion, which is in fact a cap, is mounted over the second contacts and the main unstripped cable to form a strain relief structure for said cable.

The bus bar means has removable resilient, spring-like tabs or fingers extending downwardly therefrom to press against selected ones of said first contacts and make electrical contact therewith. More specifically, by removing preselected ones of said tabs before assembly of the connector only selected ones of the said first contact, i.e., signal wire positions, will be grounded. If a signal wire is present in the signal wire position it will become grounded.

In accordance with a feature of the invention the second slot means formed in each of the said second contacts has an inverted "Y" shaped dual slot configuration with te common stem of said "Y" opening onto the second end of the contact, and into which the two ground wires are simultaneously inserted, and then branching into two separate slots, each of which receives and retains one of the two ground wires inserted into the common entry slot.

BRIEF DESCRIPTION OF THE DRAWINGS

The above-mentioned and other objects and features of the invention will be more fully understood from the following detailed description thereof when read in conjunction with the drawings in which.

DETAILED DESCRIPTION OF THE INVENTION

Figures 1, 2:
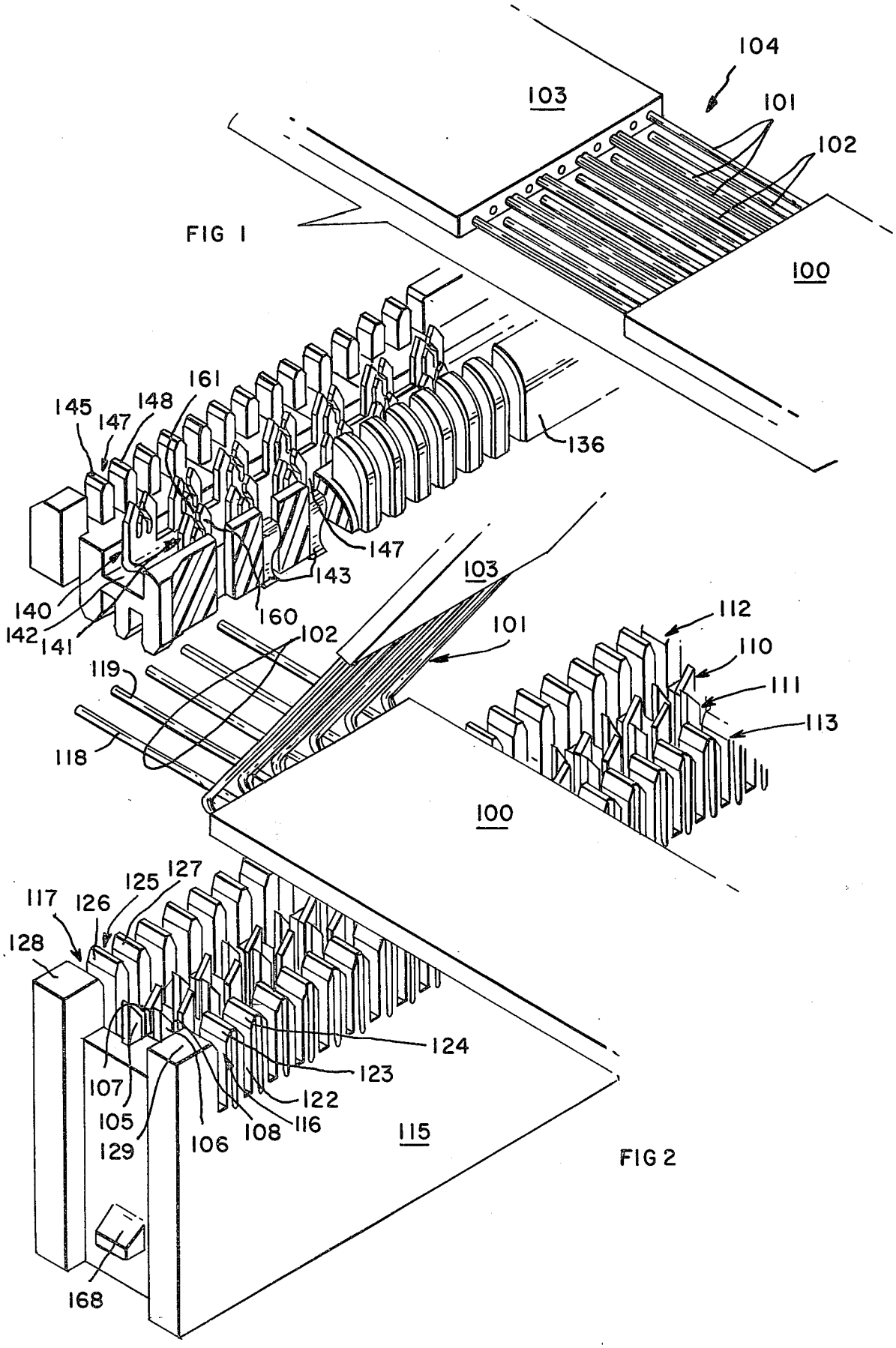
FIG. 1 is an isometric view of a flat multi-wire cable with the end thereof dressed for assembly with the connector.
FIG. 2 is an isometric view of the cable with the end portion thereof bent back and poised above the main housing section of the connector and with first contacts secured therein which retain the signal wires, and further showing the second housing section which is employed to secure the signal wires in the first housing section and which has second contacts to receive the ground wires at a later stage of assembly.

Referring now to FIG. 1 there is shown an insulated flat multi-wire cable 100 with the insulation having been stripped from a portion 104 thereof to expose the wires within the cable. The wires are divided into two groups, one of which are ground wires and identified by reference character 101 and which are positioned in pairs between the signal wires designated generally by reference character 102. The signal wires 102 are severed at the left hand end in FIG. 1, which is the end of the stripped portion of the cable nearest that end of the cable which is being terminated. A short section 103 of the cable is left in an unstripped condition in order to maintain alignment of the ground wires 101 and signal wires 102 during assembly of the connector on the cable.

It is to be understood that while the arrangement of signal and ground wires is such that each adjacent pair of signal wires is separated by two ground wires, or worded in another way, each signal wire has a ground wire on either side thereof unique to such signal wire, other configurations of ground and signal wires can be employed. The purpose of employing two ground wires between each pair of signal wires is to assure that the signal wires are electrically isolated from each other to minimize cross-talk or signal interference between signal wires.

Referring now to FIG. 2 the first housing section 115 has two rows 110 and 111 of staggered and slotted contacts mounted thereon, a flat multi-wire cable 100 with the end 103 thereof dressed for termination in the connector, and a second housing portion 136 of the connector with two additional rows 140 and 141 of dual slotted contacts secured thereon.

In FIG. 2 the end of the cable 100 is folded back upon itself across the ground wires 101 leaving the signal wires 102 extending outwardly from the main cable body 100. Each of the signal wires 102 is to be inserted in one of the slots of the contacts of the two rows of contacts 110 and 111. For example, the signal wire 118 is insertable in slot 107 in slotted contact 105 in row 110 of contacts. The next adjacent signal wire 119 is insertable in slot 108 of slotted contact 106 in row 111 of contacts. Similarly, the remaining signal wires 102 are alternately insertable in the slotted contacts in rows 110 and 111 in alternate and consecutive manner, but not necessarily in all contacts.

Further, each signal wire, such as signal wire 118, fits within opposing slots formed between ribs in the two rows of ribs 112 and 113 in the main housing portion 115. Specifically, signal wire 118 fits in slot 117 between rib 126 and end section 128 on one side of the slotted contact 105 and also fits in slot 116 which is formed between rib 123 and the end section 129 in the housing on the other side of slotted contact 105. Similarly, signal wire 119 fits within slot 125 between ribs 126 and 127 on one side of slotted contact 106 and in slot 122 between ribs 123 and 124 on the other side of slotted contact 106.

Figure 6:
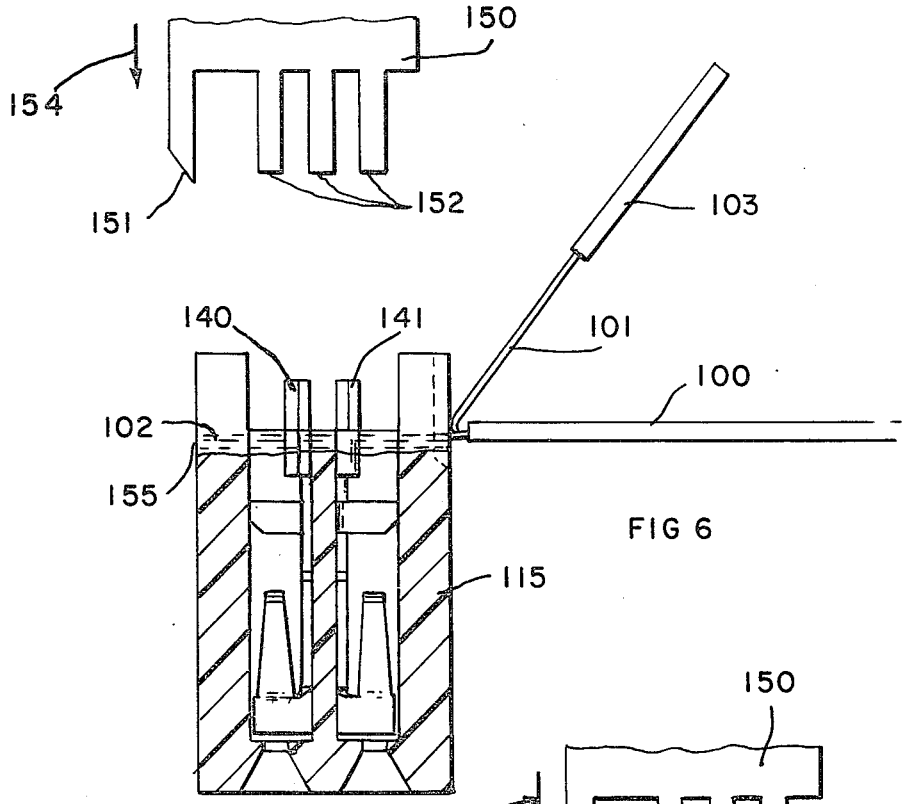
FIG. 6 is a simplified side view of the connector again showing only the signal wires installed in the slots in those first contacts which are secured within the main housing section, and with a cutting and installation tool positioned thereabove after said tool has performed its function.

All of the signal wires 118, 119 and 102 are inserted into the slots of contacts in rows 110 and 111 by means of a tool 150, as shown in FIG. 6. The tool 150 has three ribs 152 formed thereon which are moved downwardly in the direction of arrow 154 onto both sides of the rows of contacts 110 and 111 to force the signal wires 102 into the slots in contacts 110 and 111. Simultaneously, a knife blade 151 descends in the direction of arrow 154 to cut off the signal wires 102 at point 155 which is substantially flush with the outer wall surface of housing 115.

Figure 4:
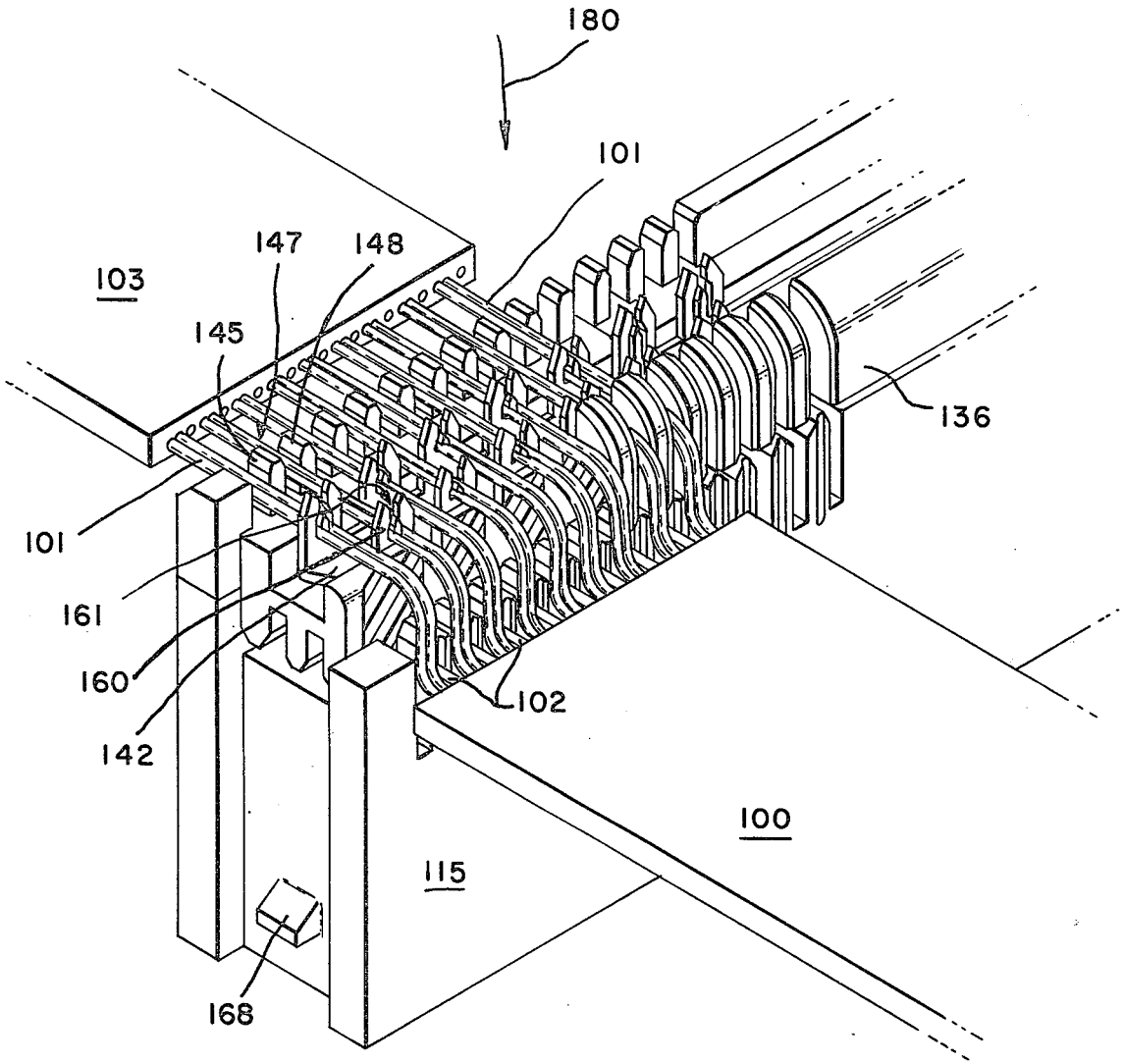
FIG. 4 shows the second housing section of the connector positioned in place over the main housing section and further shows the ground wires inserted into slots in the second contacts secured in said second housing section.

As shown in FIG. 4 the second housing section 136 is positioned over the first housing section 115 after the signal wires 102 are inserted into the slots in the contacts of rows 110 and 111, and the end 103 of cable 100 then folded back so that ground wires 101 enter the slots in the two rows of contacts 140 and 141 which are secured in the second housing portion 136.

Figure 7:
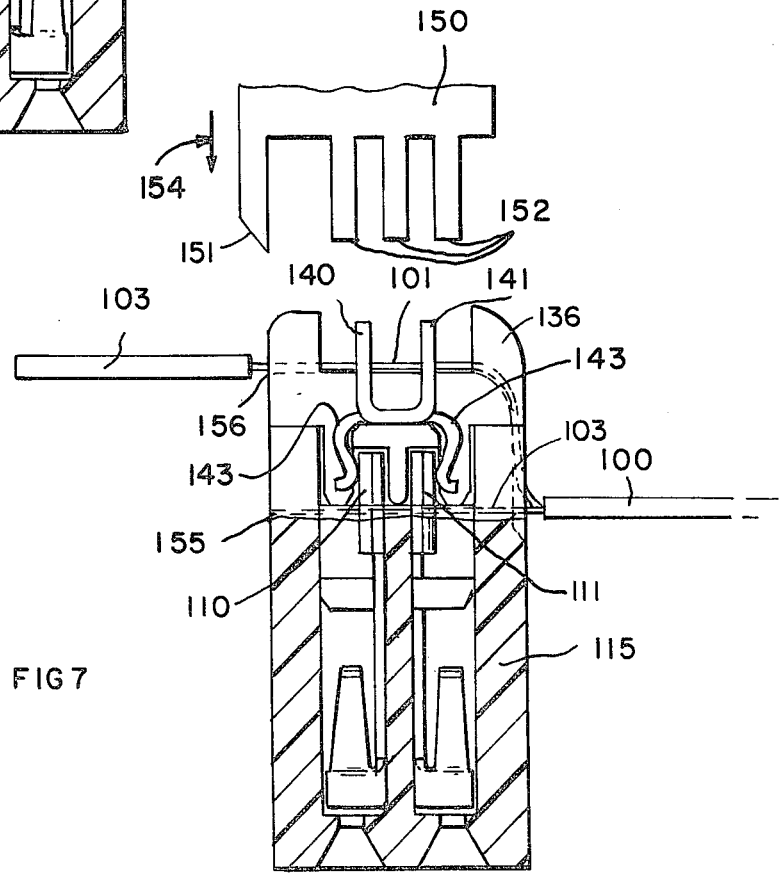
FIG. 7 is another simplified sectional view of the connector with the second housing section containing the second contacts mounted upon the first housing section and with the ground wires of the flat cable installed in slots in said second contacts by the tool shown poised thereabove.

Referring again to FIGS. 2 and 11 it can be seen in the housing portion 136 that the two rows of slotted contacts 140 and 141 are secured to a common transverse bus bar means 152. The two rows of contacts 140 and 141 and the common transverse element 142 are all stamped from the same sheet of metal. Also stamped from the same sheet of metal are resilient, finger-like removable tabs, such as tabs 143 of FIG. 2, which extend across grooves in the housing 136, such as groove 147, down towards the lower surface of the housing portion 136. In fact, groove 147 continues down the wall of housing 136 so that tabs 143, which are not removed, make a pressure contact individually with selected ones of first contacts 110 and 111 retained within main housing 115. Reference is made to FIG. 7 which shows tabs 143 extending from the upper contacts 140 and 141 downwardly to make contact with the contacts 110 and 111 contained in housing portion 115. In FIG. 7 the second housing portion 136 is shown secured in its final position over first housing portion 115. Also as shown in FIG. 7 the end 103 of the cable 100 is folded forward to the left so that ground wires 101 are inserted into the slots in the contacts 140 and 141. The tool 150 is again moved downwardly in the direction of arrow 154 to push the ground wires 101 into the slots of contacts 140 and 141 and also to sever the end 103 of cable 100 off at point 156.

Referring to FIG. 4 there is shown a perspective view of the connector at the stage of assembly shown in FIG. 7, that is, with ground wires 101 installed in the slots in the rows of contacts 140 and 141.

Figure 3:
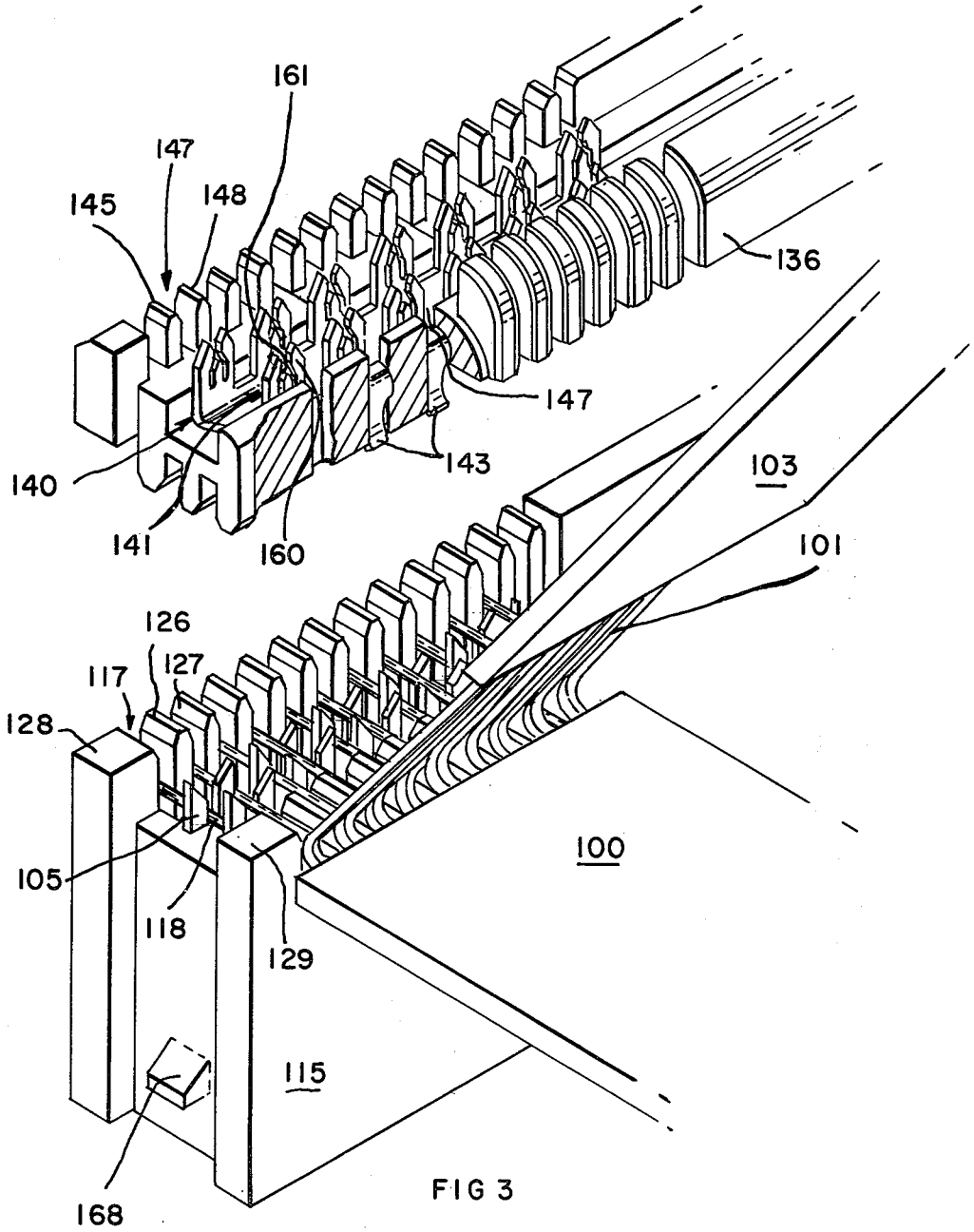
FIG. 3 shows an isometric view substantially the same as FIG. 2 but with the signal wires inserted into the slots in the first contacts in the main housing section.
Figure 9:
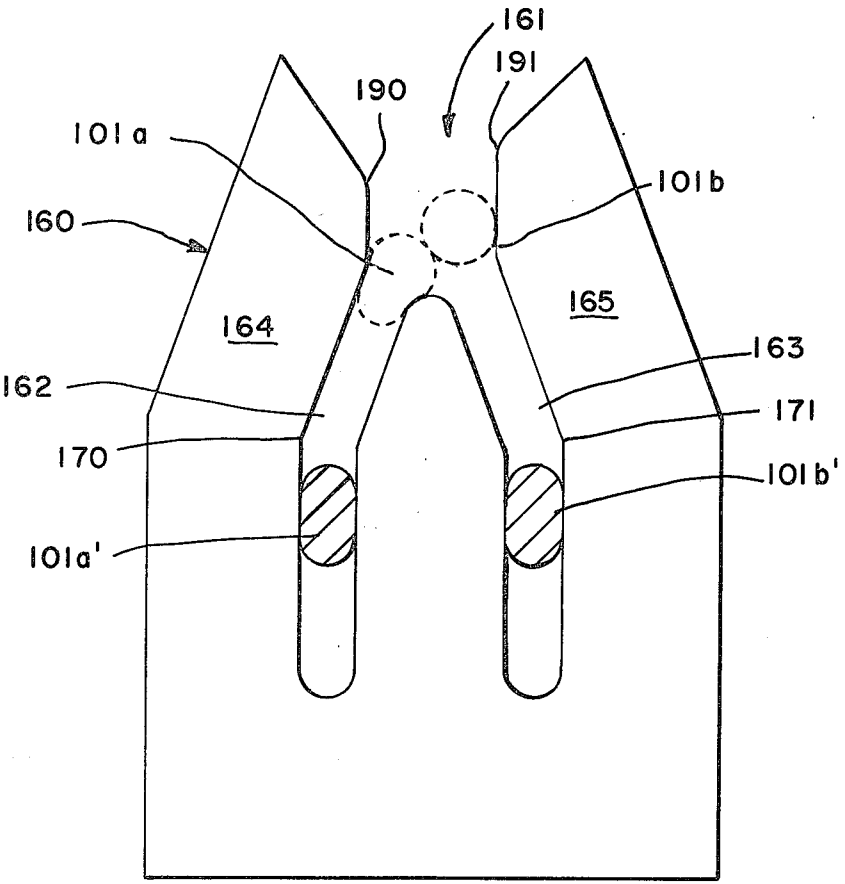
FIG. 9 shows a form of a dual slotted contact.

The details of the formation of the ribs, such as ribs 145 and 148, of the housing section 136 can best be seen in FIGS. 2 and 3. Between each pair of ribs, such as ribs 145 and 148, two ground wires can be positioned. The two ground wires which are positioned between said each pair of adjacent ribs, such as ribs 145 and 148, are also positioned in the same dual slotted contact, such as contact 160 in FIG. 2. The slotted contact 160 has an inverted Y-shaped slot 161 formed therein, which is shown in detail and in enlarged form in FIG. 9. The slot 161 opens onto the upper end of the contact 160 to receive two ground wires **101*a* and 101*b*. As the two ground wires 101*a* and 101*b* are inserted down to the point where the slot 161 branches into the two slots 162 and 163 the said ground wires 101*a* and 101*b* will each enter into a different one of the two branching slots 162 and 163 and be retained therein by the spring retention action of the segments 164 and 165 of contact 160 at the positions indicated by reference characters 101*a*′ and 101*b*′**. A more detailed discussion of the dual slotted contacts will be set forth later herein.

Figure 8:
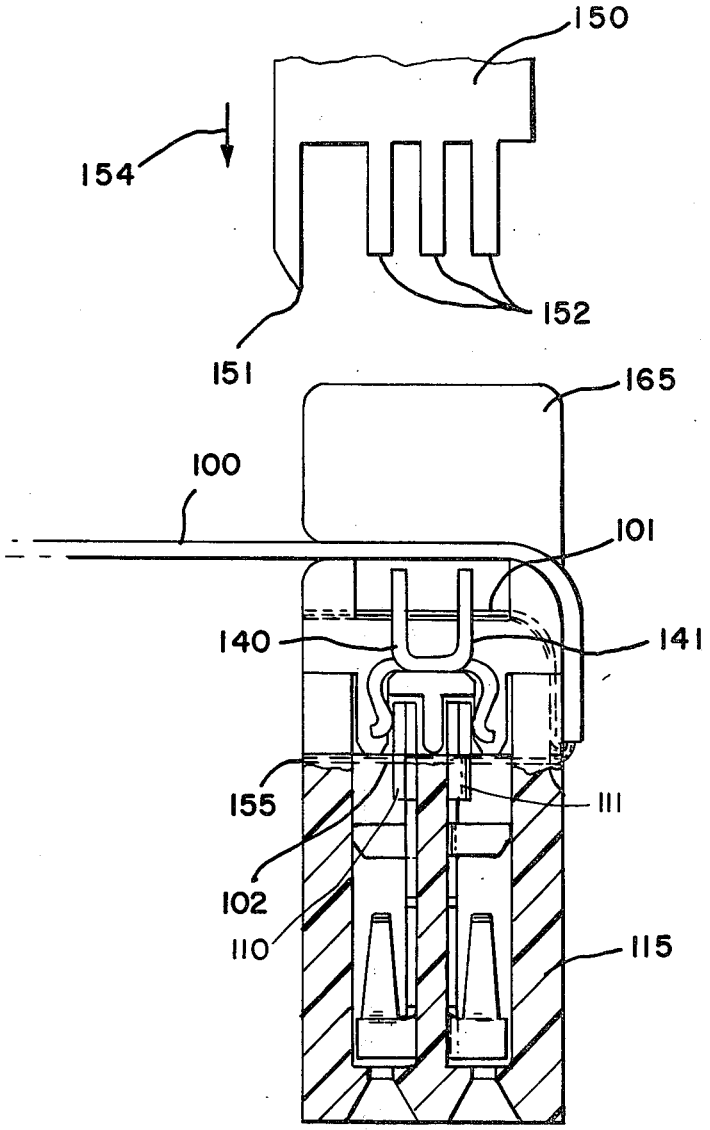
FIG. 8 shows a sectional view of the completed assembly of the connector with the cap section of the housing installed thereon.

In the next step of the assembly the main body 100 of the flat cable is folded over the top of the two rows of contacts 140 and 141 in the manner shown in FIG. 8 and a cap portion 165 of the housing positioned thereover and retained by a suitable latching means with the main body of the housing. More specifically, as shown in FIG. 5 the cap portion 165 can be seen to have side legs, such as side leg 166, with an aperture 167 formed therein which secures over a pawl element 168 located on housing portion 115, also shown in FIG. 4.

Looking down from the top of the connector as shown in FIG. 4 the spacing between the signal wires 102 and the ground wires 101, and the alignment relation thereof, is substantially the same as exists within the insulated cable 100.

Figure 5:
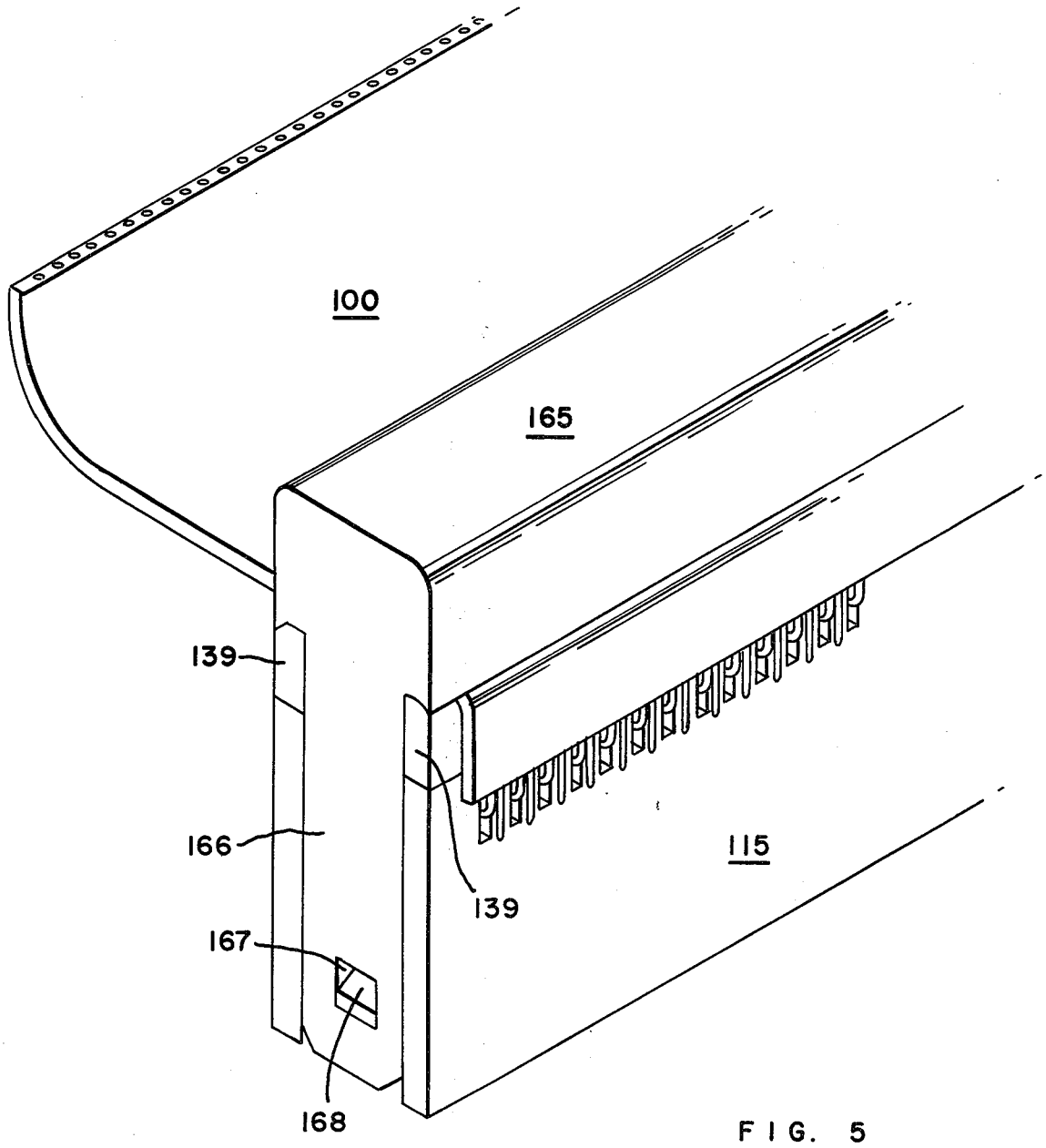
FIG. 5 shows the connector completely assembled with a third section of the housing, which is a cap, installed thereon.

In FIGS. 8 and 5 the main body 100 of the coaxial cable 100 is shown as having been folded back across the top of the dual slotted contacts 140 and 141 of housing portion 136 before the cap 165 is installed thereover to provide an anti-strain function for the terminated end of the cable.

Referring again to FIG. 9 the flared entry of slot 161 is defined in part by two points 190 and 191 (also shown in FIG. 10) which define the lower limits of such flared entry. It can be seen that point 190 is at a lower level than point 191 to assist in causing one of the wires **101*a* or 101*b* to precede the other wire down into the slot 161, thus avoiding jamming of the two wires 101*a* and 101*b* together as they move into said slot 161. The final position of the two wires 101*a* and 101*b* is shown as being at 101*a*′ and 101*b*′ in the portions of slots 162 and 163 below the knees 170 and 171. The knees 170 and 171 are employed in order to make the slot long enough to provide a resilient spring motion in the leg-like portions 164 and 165**.

Figure 10:
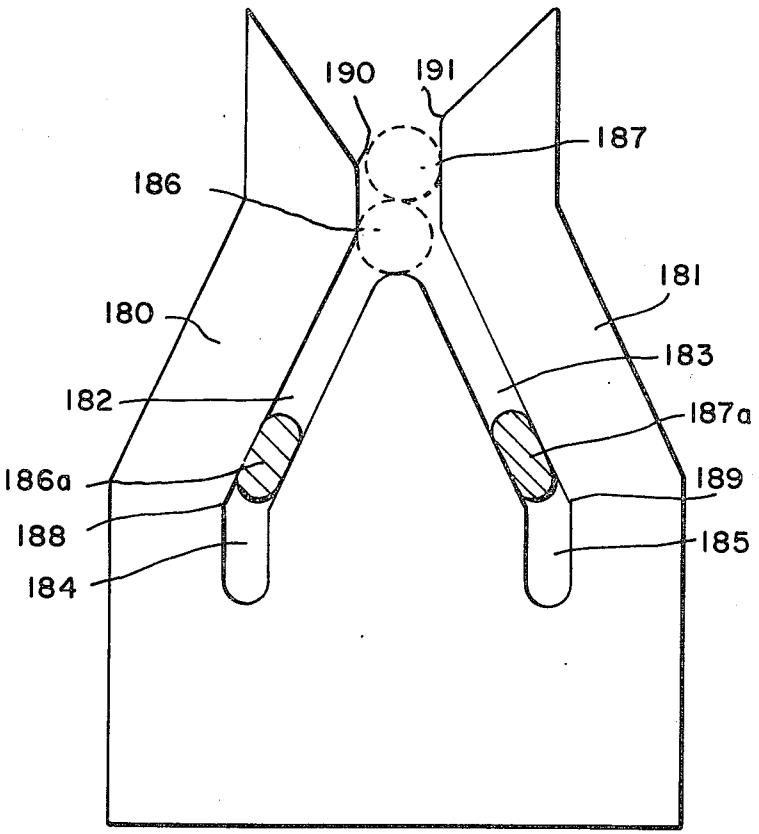
FIG. 10 shows another form of a dual slotted contact.

It has been found advantageous, with certain sized wires, especially smaller wires, to not insert such wires beyond the knees 170 and 171 in slots 162 and 163. To accommodate such instances the knee portions can be lowered in the contact without derogating the resilient spring-like action of the legs of the contact. Reference is made to FIG. 10 which shows the knees 188 and 189 moved downwardly in slots 182 and 183 so that the final position of wires 186 and 187 is as represented by reference characters **186*a* and 187*a*. It can be seen that in their final positions the wires 186*a* and 187*a* do not pass beyond knees 188 and to enter into slot sections 184** and 185 which are provided to give a longer beam effect to legs 180 and 181.

Figure 11:
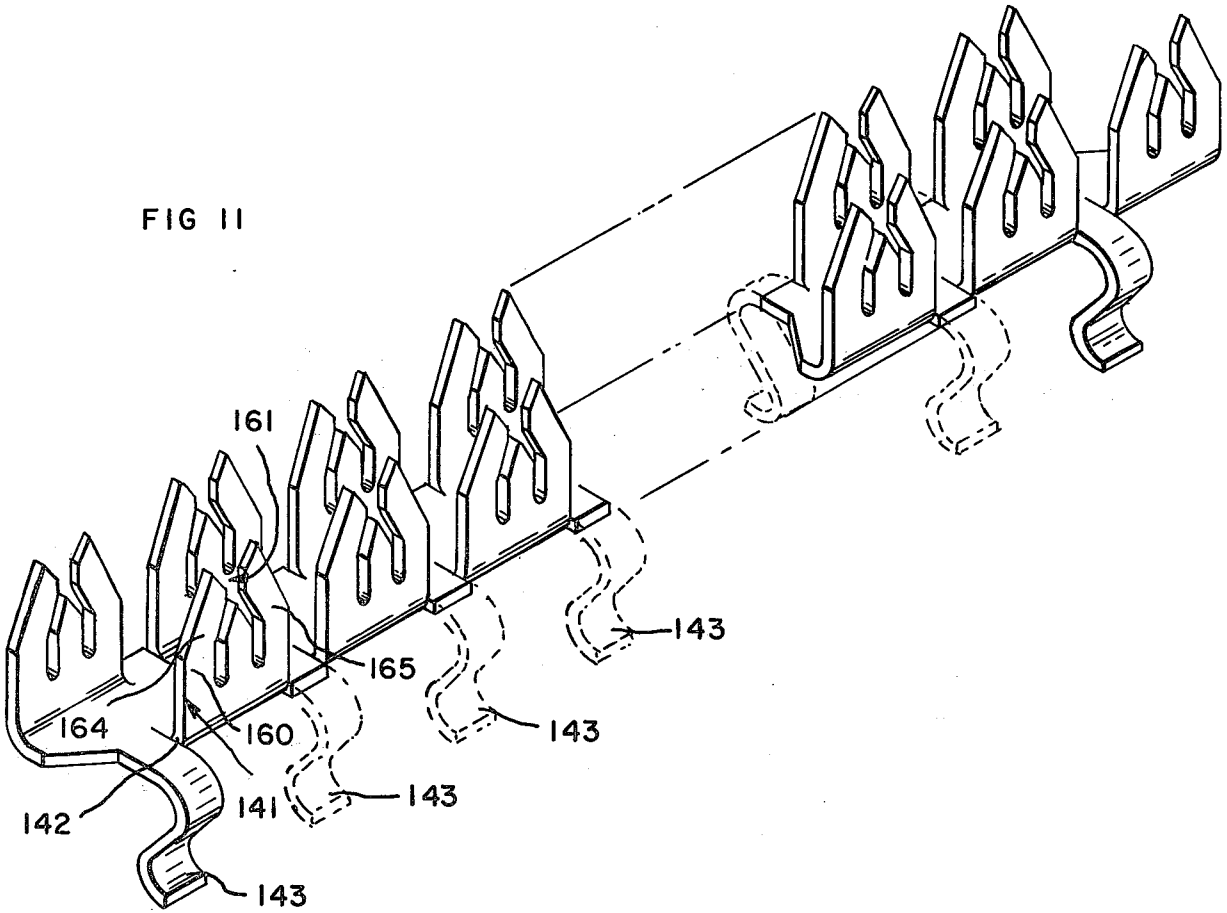
FIG. 11 shows an isometric view of the bus bar arrangement of said dual slotted contacts.

In FIG. 11 there is shown an isometric view of the dual slotted contacts 140 and 141 as they are normally secured on a common transverse element 142 to provide a bus bar and contacts for supplying ground potential, or some other desired reference potential, to various points in the connector. The tabs 143 are stamped and formed from the same flat piece of metal as contacts 140 and 141 and the common transverse element 142.

Figure 12:
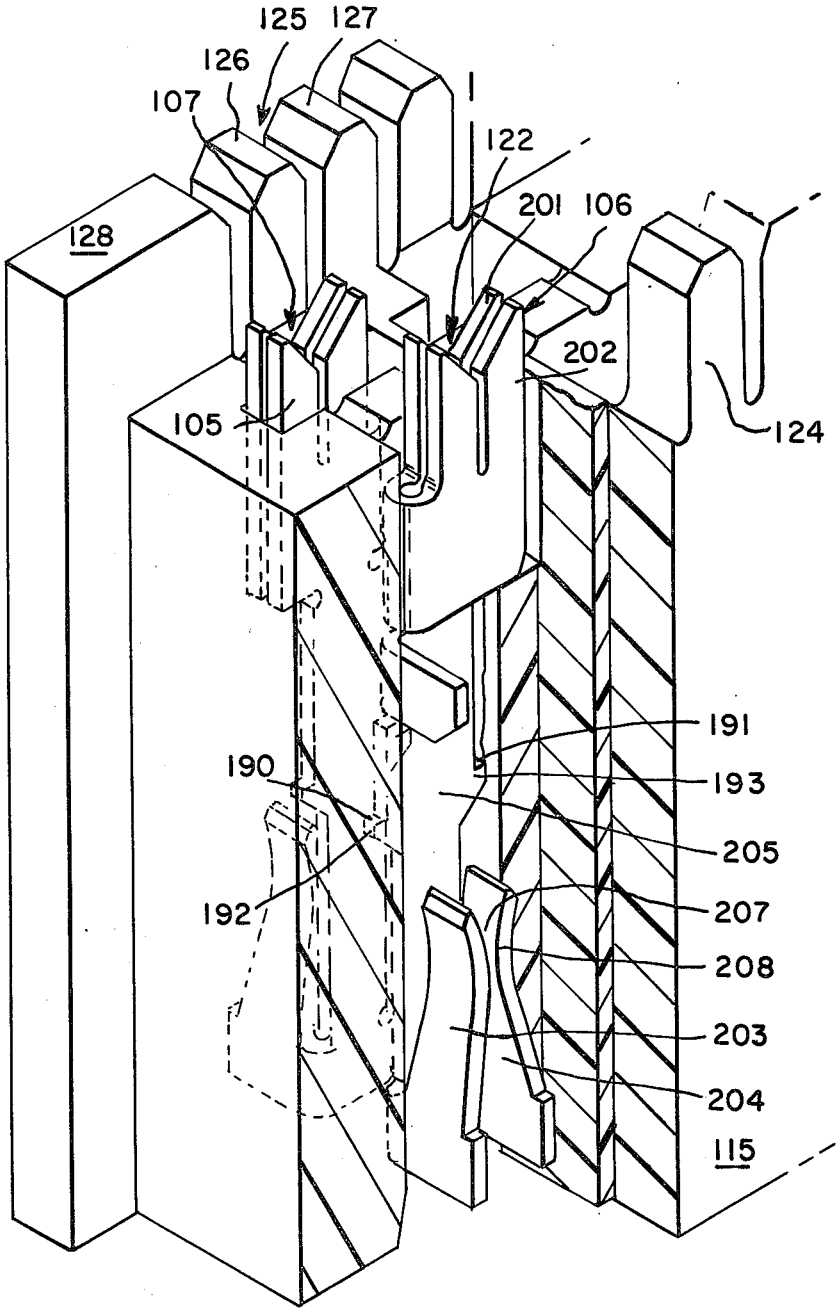
FIG. 12 is an isometric view of two of the single slotted contacts employed to receive signal wires and a broken away portion of the housing which retains said contacts.

In FIG. 12 there is shown a partially broken-away isometric view of two of the single slotted contacts, as for example contacts 105 and 106, and the manner in which they are secured in the main housing portion 115 of FIG. 2. Each of such single slotted contacts is stamped from a single sheet of metal and, if desired, can be of double thickness in that two plate-like sections 201 and 202 are formed into mirror images of each other and then folded upon each other in the manner shown in FIG. 12. The legs 203 and 204 of contact 106 extend from connecting element 185 and are bowed with their convex surfaces 207 and 208 facing each other. A terminal post (not shown) is insertable between the bowed legs 203 and 204.

Retention of the contact 106 within the housing 115 is effected by shoulders 190 and 191 within the housing 115 behind which tangs 192 and 193 on connecting element 185 of contact 106 lock.

While the lower ends of contacts 110 and 111 are shown as pairs of bowed springs constructed to receive terminal posts, they can be of other configurations without departing from the spirit of the invention. For example, they can be terminal posts which mate with apertures in a printed circuit board or female receptacles in a mating connection.

In a manner different from that described hereinbefore and not specifically shown in the drawings the connector and the cable can be assembled in one step as follows. The signal wires 102, the housing portion 136, and the ground wires 101 (see FIG. 7) can be positioned one above the other but without the signal wires 102 or the ground wires 101 being inserted in slots in the contacts 110 and 111 or contacts 140 and 141 respectively. A tool similar to the tool 150 of FIGS. 6 and 7, but with a longer shear blade 151, is then brought down upon the pre-assembly structure described above, and in one stroke causes the housing 136 to insert the signal wires 102 in the slots in contacts 110 and 111 and the ground wires in the slots in contacts 140 and 141, thus completely assembling the structure except for the cap portion 165 (see FIG. 8).

Throughout the specification the wires of the flat cable which are inserted within the single slotted contacts, such as contacts 105 an 106 of housing 115, are designated as signal wires, and the wires retained within the double slotted contacts 140 and 141 of FIG. 2 are designated as ground wires, with the two ground wires being interspaced between each pair of adjacent signal wires. However, other arrangements of ground and signal wires can be obtained with the present invention. For example, a signal ground wire can be interleaved between each pair of signal wires with a resulting GS GS — GS configuration of wires as compared with the SGG SGG SGG arrangement discussed above, where S represents a signal wire and G represents a ground wire.

It is to be understood that the forms of the invention shown and described herein are but preferred embodiments thereof and that various changes can be made in design such as in centerline spacing and slot configurations without departing from the spirit or scope of the invention.

I claim:

1. The combination of a flat multi-wire cable and a connector for terminating the wires of said cable as first purpose wires or second purpose wires and in which the end of said cable to be terminated has a portion thereof stripped of insulation but with a section of insulated cable remaining between the stripped portion and the end of the cable and further in which said connector comprises:

a first housing section having a first surface;

at least two rows of first contacts each secured at a first end thereof within said first housing section with the other end thereof extending out of said first surface of said first housing section, each of said first contacts having first wire retaining slot means formed therein which opens onto said other end thereof and with the slots of the contacts of one row being staggered with respect to the slots of the contacts of the other row;

each of the stripped first purpose wires of said cable being inserted in one of said first slot means;

a second housing section having a first surface configured to mate with the first surface of said first housing section to retain said first purpose wires therein and with a second surface formed thereon;

common bus bar means secured in said second housing section;

at least two rows of second contacts each connected at a first end thereof to said common bus bar means and with the other end extending out of said second surface of said second housing section with each of said second contacts having second wire retaining slot means formed therein and further with the slot means of the contacts of one row of second contacts being staggered with respect to the slot means of the contacts of the other row of second contacts;

a plurality of removable, resilient tabs connected at one end to said common bus bar means and extending downwardly to make a spring-like contact with selected ones of said first contacts;

each of said stripped second purpose wires being inserted in one of said second slot means in said second contacts; and third housing means constructed to fit over said second surface of said second housing means to secure said cable in said connector and provide strain relief therefor.

2. A combination as in claim 1 in which each of said second slot means has a generally inverted "Y" shaped configuration with the stem of the "Y" shaped slot opening onto the said other end of said second contact and the branching arms of the slot extending towards the first end of said second contact.

3. A combination as in claim 1 in which said two rows of second contacts are positioned substantially above said two rows of first contacts with said tabs extending from said common bus bar means to selected first contacts positioned therebelow.

4. A combination as in claim 1 in which said first slot means and said second slot means are positioned with respect to each other to retain each wire inserted therein in a plane which is substantially parallel to a common reference plane, which planes are spaced apart a distance equal to the distance between adjacent wires in said multi-wire cable.

5. The combination of a multi-wire cable and a connector for terminating the wires of said cable as signal wires or ground wires and in which the terminated end of said cable has a portion thereof stripped of insulation but with a section of insulated cable remaining between the stripped portion and the end of the cable and further in which the said connector comprises:

first housing means having a first surface;

at least two rows of first contacts each secured at a first end thereof within said first housing means with the other end thereof extending out of said first surface of said first housing section and further with the said other ends of the contacts of one row being staggered with respect to the said other ends of the contacts of the other row and with each of said first contacts having a first wire retaining slot means therein which opens onto said other end thereof;

a stripped signal wire of said cable being inserted in each of said first slot means;

a second housing means having a first surface mountable on said first surface of said first housing means and configured to retain said signal wires in said first slot means and further having a second surface formed thereon;

bus bar means secured in said second housing means;

at least two rows of second contacts each secured at a first end thereof to said bus bar means with the other end thereof extending out of said second surface and further with the said other ends of the contacts of one row if said second contacts being staggered with respect to the said other ends of the contacts of the other row of second contacts;

each of said second contacts having a second wire retaining slot means formed therein which opens onto said other end thereof;

a plurality of removable resilient, spring-like tabs each secured at one end to said bus bar means and with the other end extending towards and making a pressure electrical contact with a selected one of said first contacts to ground said selected ones of said first contacts;

each of said stripped ground wires being inserted in one of said slots in said second contacts; and third housing means constructed to fit over said second surface of said second housing means to secure said cable in said connector.

6. A combination as in claim 5 in which each of said second slot means has a generally inverted "Y" shaped configuration with the stem of the "Y" shaped slot opening onto the said other end of the particular second contact in which it is formed and the branching arms of the slot extending towards the first end of said particular second contact.

7. A combination as in claim 5 in which said two rows of second contacts are positioned substantially above the said two rows of first contacts with the tabs from said busbar means extending down to selected ones of said first contacts.

8. A combination as in claim 5 in which said first and second slot means are positioned with respect to each other to retain each wire inserted therein in a plane which is parallel to a common reference plane, which planes are spaced apart a distance equal to the distance between adjacent wires in said multi-wire cable.

9. The combination of a flat multi-wire cable and a connectr for terminating the wires of said cable as first purpose wires or second purpose wires and in whch the end of said cable to be terminated has a portion thereof stripped of insulation but with a section of insulated cable remaining between the stripped portion and the end of the cable and further in which said connector comprises:

a first housing section having a first surface;

at least two rows of first contacts each secured at a first end thereof within said first housing section with the other end thereof extending out of said first surface of said first housing section, each of said first contacts having first wire retaining slot means formed therein which opens onto said other end thereof and with the slots of the contacts of one row being staggered with respect to the slots of the contacts of the other row;

each of the stripped first purpose wires of said cable being inserted in one of said first slot means;

a second housing section having a first surface configured to mate with the first surface of said first housing section to retain said first purpose wires therein and with a second surface formed thereon;

common bus bar means secured in said second housing section;

at least two rows of second contacts each connected at a first end thereof to said common bus bar means and with the other end extending out of said second surface of said second housing section with each of said second contacts having second wire retaining slot means formed therein and further with the slot means of the contacts of one row of second contacts being staggered with respect to the slot means of the contacts of the other row of second contacts;

a plurality of removable, resilient tabs connected at one end to said common bus bar means and extending downwardly to make a springlike contact with selected ones of said first contacts;

each of said stripped second purpose wires being inserted in one of said second slot means in said second contacts; and third housing means constructed to fit over said second surface of said second housing means to secure said cable in said connector and provide strain relief therefor;

said combination being produced by the method comprising the steps of;

stripping the insulation off said portion of said wire;

severing the first purpose wires near the first end of the stripped portion of the cable which is nearest that end of said cable to be terminated;

folding back said cable upon itself in a first direction at a fold line ear the second end of said stripped portion but leaving said first purpose wires unfolded;

inserting said first purpose wires in said first slots in a substantially parallel relation with each other;

assembling said second housing portion section with said second contacts therein over said first contacts and said first housing portion section;

folding back said cable upon itself in a second direction opposite said first direction near the second end of said stripped portion;

inserting said second purpose wires in said second slots in a substantially parallel relation with each other;

severing the said remaining unstripped section of cable and leaving said second purpose ground wires within said second slots folding back said insulated cable in said first direction over the said second contacts; and installing said third housing section over said second contacts.

* * * * *